US011185119B2

(12) United States Patent
Diamond

(10) Patent No.: US 11,185,119 B2
(45) Date of Patent: Nov. 30, 2021

(54) PROTECTIVE GARMENTS INCORPORATING IMPACT RESISTANT STRUCTURES

(71) Applicant: Richard Diamond, Far Hills, NJ (US)

(72) Inventor: Richard Diamond, Far Hills, NJ (US)

( * ) Notice: Subject to any disclaimer, the term of this patent is extended or adjusted under 35 U.S.C. 154(b) by 153 days.

(21) Appl. No.: 16/110,896

(22) Filed: Aug. 23, 2018

(65) Prior Publication Data

US 2019/0104792 A1 Apr. 11, 2019

Related U.S. Application Data

(63) Continuation-in-part of application No. 15/726,797, filed on Oct. 6, 2017, now abandoned.

(51) Int. Cl.

| | |
|---|---|
| ***F41H 1/02*** | (2006.01) |
| ***F41H 5/04*** | (2006.01) |
| ***A41D 13/015*** | (2006.01) |
| ***A41D 31/28*** | (2019.01) |
| ***A41D 13/05*** | (2006.01) |
| ***A41D 31/24*** | (2019.01) |
| ***A41D 1/04*** | (2006.01) |
| ***A63B 71/12*** | (2006.01) |

(52) U.S. Cl.

CPC ..... *A41D 31/245* (2019.02); *A41D 1/04* (2013.01); *A41D 13/015* (2013.01); *A41D 13/0153* (2013.01); *A41D 13/0512* (2013.01); *A41D 13/0531* (2013.01); *A41D 31/285* (2019.02); *A63B 71/12* (2013.01); *F41H 1/02* (2013.01); *F41H 5/0492* (2013.01); *A41D 31/28* (2019.02); *A41D 2600/10* (2013.01); *A63B 2071/1208* (2013.01)

(58) Field of Classification Search

None

See application file for complete search history.

(56) References Cited

U.S. PATENT DOCUMENTS

| | | | |
|---|---|---|---|
| 4,453,271 | A | 6/1984 | Donzis |
| 4,700,407 | A | 10/1987 | Mattila |
| 4,810,559 | A | 3/1989 | Fortier et al. |
| 4,870,706 | A | 10/1989 | Ketcham et al. |
| 5,105,473 | A | 4/1992 | Valtakari |
| 5,235,703 | A | 8/1993 | Maynard |
| 5,551,082 | A | 9/1996 | Stewart et al. |
| 6,058,503 | A | 5/2000 | Williams |
| 2007/0199129 | A1 | 8/2007 | Davis |

(Continued)

FOREIGN PATENT DOCUMENTS

EP 2062487 A2 * 5/2009 ..... A41D 13/0531

*Primary Examiner* — Jeremy R Pierce
*Assistant Examiner* — Christine X Nisula
(74) *Attorney, Agent, or Firm* — Thomas J. Germinario

(57) ABSTRACT

A protective garment comprising multi-layered composite structures is conformable to the contours of the body parts for which protection is required. The composite structure contains rigid impact-deflecting outer structures, impact-dissipating gel middle layers, and impact-damping micro-lattice lower layers. In one embodiment, the structure is designed for impacts associated with contact sports, such as football, hockey and lacrosse. In another embodiment, the structure is designed for military/police applications, in which impacts can be blunt forces, from weapons such as clubs, or penetrative forces, from knives, bullets or shrapnel.

16 Claims, 5 Drawing Sheets

(56) References Cited

U.S. PATENT DOCUMENTS

| | | | | |
|---|---|---|---|---|
| 2008/0026658 | A1* | 1/2008 | Kriesel | A63B 71/081 442/182 |
| 2008/0282438 | A1* | 11/2008 | Boutaghou | A41D 19/01523 2/16 |
| 2009/0044319 | A1 | 2/2009 | Lamson et al. | |
| 2013/0283511 | A1* | 10/2013 | Diamond | A63B 71/12 2/455 |
| 2015/0101899 | A1* | 4/2015 | Russo | A42B 3/121 188/266 |
| 2016/0302496 | A1* | 10/2016 | Ferrara | A41D 13/015 |
| 2017/0307040 | A1* | 10/2017 | Schaedler | B32B 9/005 |
| 2019/0145740 | A1* | 5/2019 | Czerski | F41H 1/02 2/463 |

* cited by examiner

PROTECTIVE GARMENTS INCORPORATING IMPACT RESISTANT STRUCTURES

RELATION TO OTHER APPLICATIONS

This application is a continuation-in-part of U.S. Non-provisional patent application Ser. No. 15/726,797, filed Oct. 6, 2017, the disclosure of which is incorporated herein by reference. The present invention is also related to this inventor's U.S. Pat. No. 9,067,122 B2, "Protective Athletic Garment and Method," which is incorporated herein in its entirety.

FIELD OF INVENTION

The present invention relates to the field of garments adapted to protect a wearer's body from impacts associated with contacts sports and/or military/police activities.

BACKGROUND OF THE INVENTION

Protective garments for sports, military and police uses have evolved in the direction of becoming lighter, stronger, more mobile, and more wearable. Optionally, the structures comprising such protective garments should be capable of deflecting impact forces, damping their impact, dissipating such forces, absorbing them, and blocking penetration through to the wearer's body.

The principal problem to be solved in designing such garments is that diverse materials need to be utilized in connection with the foregoing capabilities. The task of integrating such diverse materials into a composite structure requires consideration of their interaction, which should be synergistic, such that the resultant protective effect is greater than the sum of each material's isolated contribution.

SUMMARY OF THE INVENTION

The present invention comprises a multi-layer composite garment, which is conformable to the contours of the body parts for which protection is required. In one embodiment, the garment is designed for impacts associated with contact sports, such as football, hockey and lacrosse. In another embodiment, the garment is designed for military/police applications, in which impacts can be blunt forces, from weapons such as clubs, or penetrative forces, from knives, bullets or shrapnel.

In both embodiments, the present invention deploys structures comprising one or more outer arrays of multiple rigid, impact-deflecting plates, one or more impact-dissipating middle layers containing a viscoelastic polymeric gel, and one or more impact-damping microlattice lower layers.

In the sports embodiments, the outer shock-deflecting layer of each garment is a panel or shell composed of a rigid, light-weight, impact-resistant polymer, polymer blend or ceramic material. The outer layer is sized and contoured to match the body part(s) over which it will be worn. Such sizing and contouring can be done generically according to ranges of different body types, e.g., large men's size, medium men's size, small woman's size, etc.

Alternately, the outer layer can be tailored to the body shape, size and contours of specific individual wearer's body. Such tailoring can be done by three-dimensional (3D) optical scanning of the covered body part(s) of the individual and use of the 3D optical scanning data in a 3D printer to produce the corresponding panel/shell structure. This 3D optical scanning-printing methodology can also be used to generate partial "exoskeleton" structures, such as breastplates or sleeves.

Over joints, such as shoulders, elbows, spine and knees, the outer impact-deflecting plates comprise overlapping, articulated convex shaped shells, which are interchangeably attachable to multiple plate sockets that are interconnected by a semi-rigid rail connector. The plate sockets are pivotally attached to the rail connector, such that each of the plate sockets can independently pivot about a pivot axis which is transverse to the longitudinal axis of the rail connector. The plate sockets are configured to allow replacement of any of the deflecting plates, so that interchangeable sets of deflecting plates can be deployed to accommodate different degrees of impact and/or different requirements for flexibility and mobility. For example, a protective garment for football players can have interchangeable sets of deflecting plates—one set of larger, denser, heavier plates for linemen, and another set of smaller, less dense, lighter plates for backs and receivers.

In the military/police embodiments, the structures of the outer shock-deflecting layer can be the same as those outlined above for the sports embodiments, but they will be composed of a ballistic and puncture resistant material, such as reinforced plastic, reinforced carbon fiber, graphene, titanium metal or aramid fibers.

In both sports and military/police embodiments, the lower layers of the impact resistant structures according to the present invention comprise deformable, polymer-based microlattice impact-damping layers below viscoelastic polymeric gel impact-dissipating layers. The microlattice material preferably comprises a three-dimensional interconnected network of hollow nanotubes preferably having tube diameters less than 1 mm, the stress buckling of which damps impact forces.

Above the microlattice impact-damping layers, multiple intermediate layers of viscoelastic polymeric gel are distributed above areas of the body particularly exposed or vulnerable to impacts. Optionally, pockets can be provided in the protective garment above selected portions of the microlattice layers, so that gel packets can be removably inserted as needed, depending on the level of protection required by the wearer. For a football lineman's garment, for example, additional gel packets can be used in areas such as shoulders and spine. For police and military garments, denser and/or thicker gel layers can be used to dissipate ballistic impacts.

The dissipative viscoelastic polymeric gel layers redirect the kinetic energy of an impact outward along a horizontal plane rather than allowing the impact force to penetrate through the gel layer. Commercial gel products such as DivGel® or SHOCKtec® Gel can be used, as can the gel compositions described in U.S. Pat. No. 8,461,237 and U.S. Patent Application Publication No. 2008/0026658, both of which disclosures are incorporated herein by reference.

As discussed above, the multi-layered composite impact resistant structures of the present invention can be configured as partial exoskeleton panels, which can in turn be removably interconnected to form a complete exoskeleton body armor for the upper torso, arms, lower torso, legs or a combination of some or all of these.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
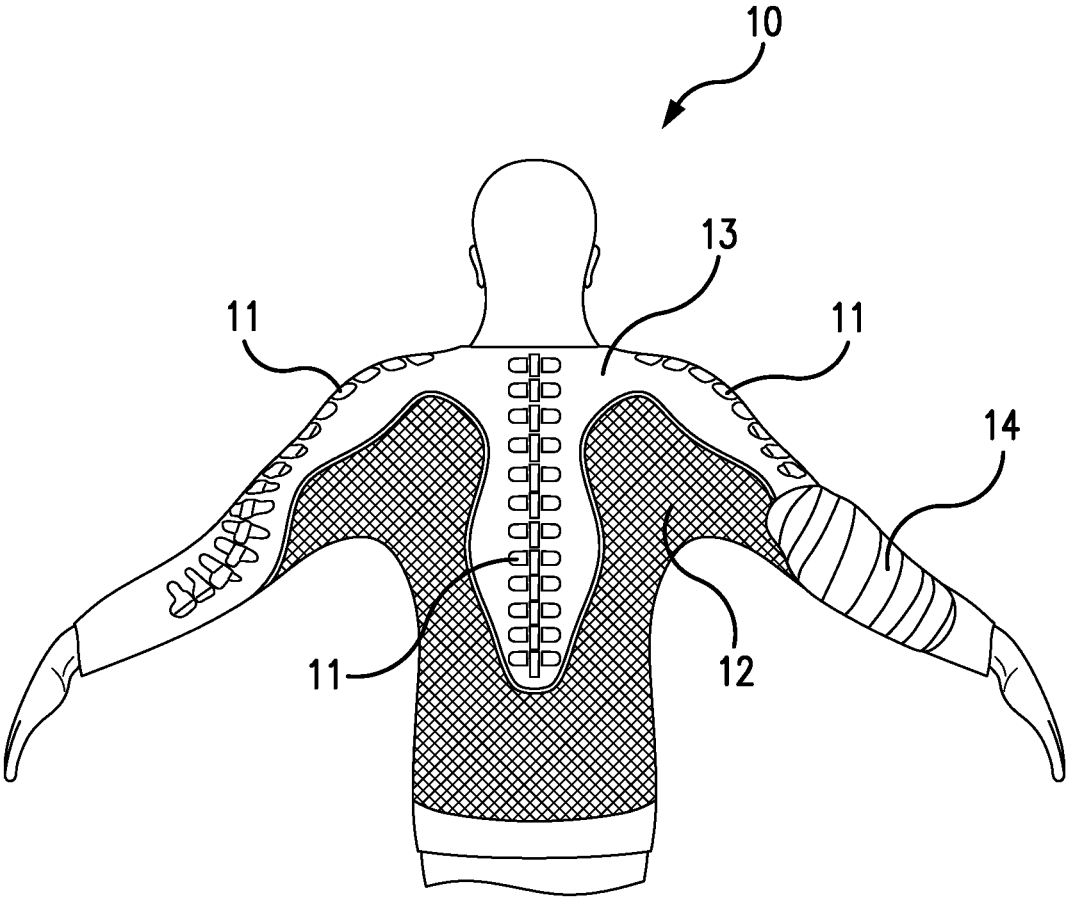
FIG. 1 is a rear perspective view of an exemplary impact resistant protective garment in accordance with one embodiment of the present invention.

Referring to FIG. 1, an exemplary impact resistant protective garment 10 comprises a rigid, impact-deflecting outer layer 11, below which is a deformable, polymer-based microlattice, impact-damping lower layer 12. Sandwiched between the outer layer 11 and the lower layer 12 is an impact-dissipating middle layer 13, containing a viscoelastic polymeric gel. In this embodiment 10, the impact-deflecting outer layer 11 comprises three curvilinear plate arrays 11 containing multiple rigid deflecting plates 14.

Figure 3A:
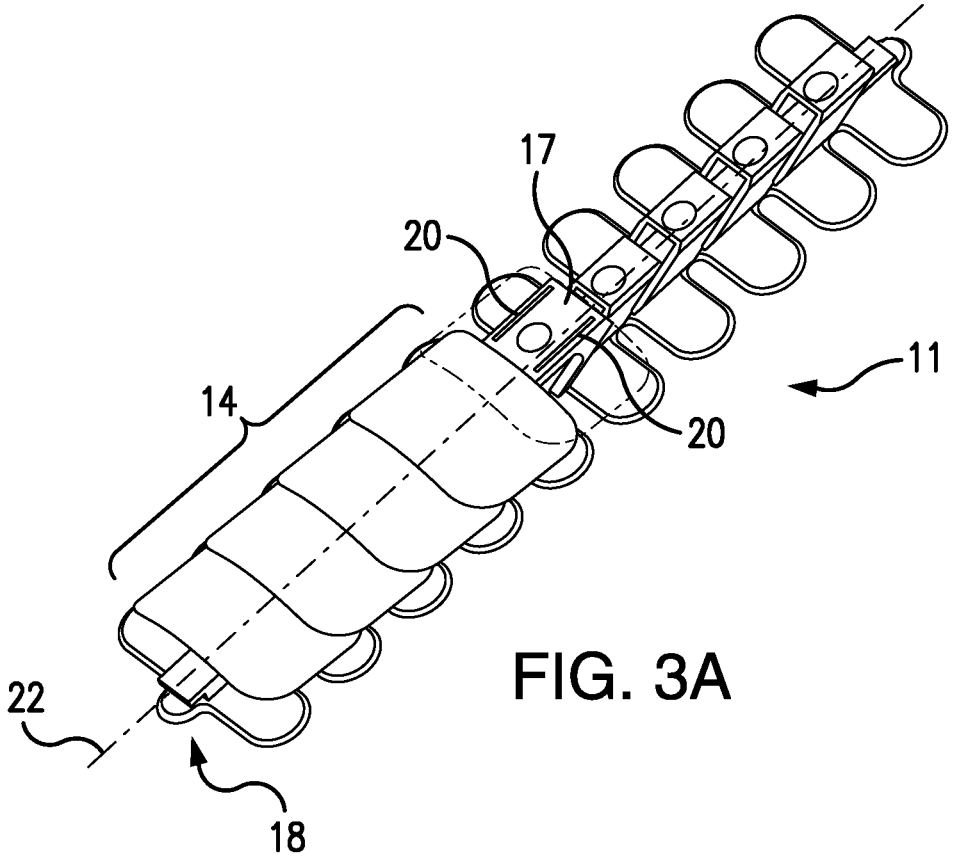
FIG. 3A is perspective view of an exemplary impact-deflecting plate array comprising a component of one embodiment of the present invention.
Figure 3B:
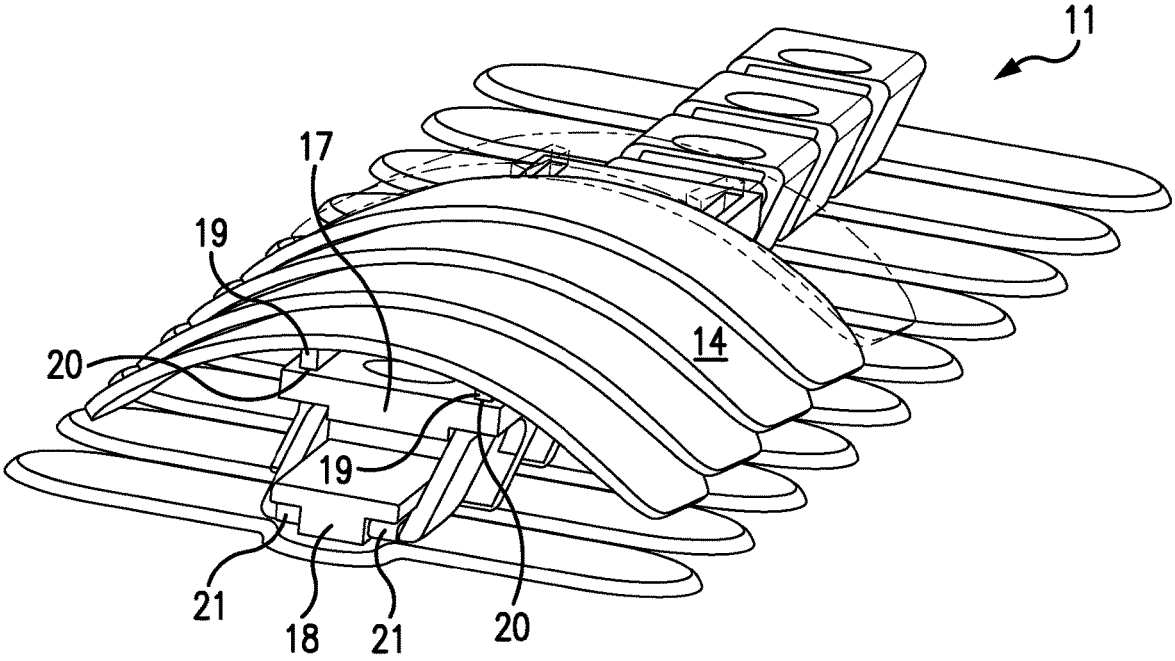
FIGS. 3B and 3C are detail perspective views of the exemplary impact-deflecting plate array shown in FIG. 3A.
Figure 3C:
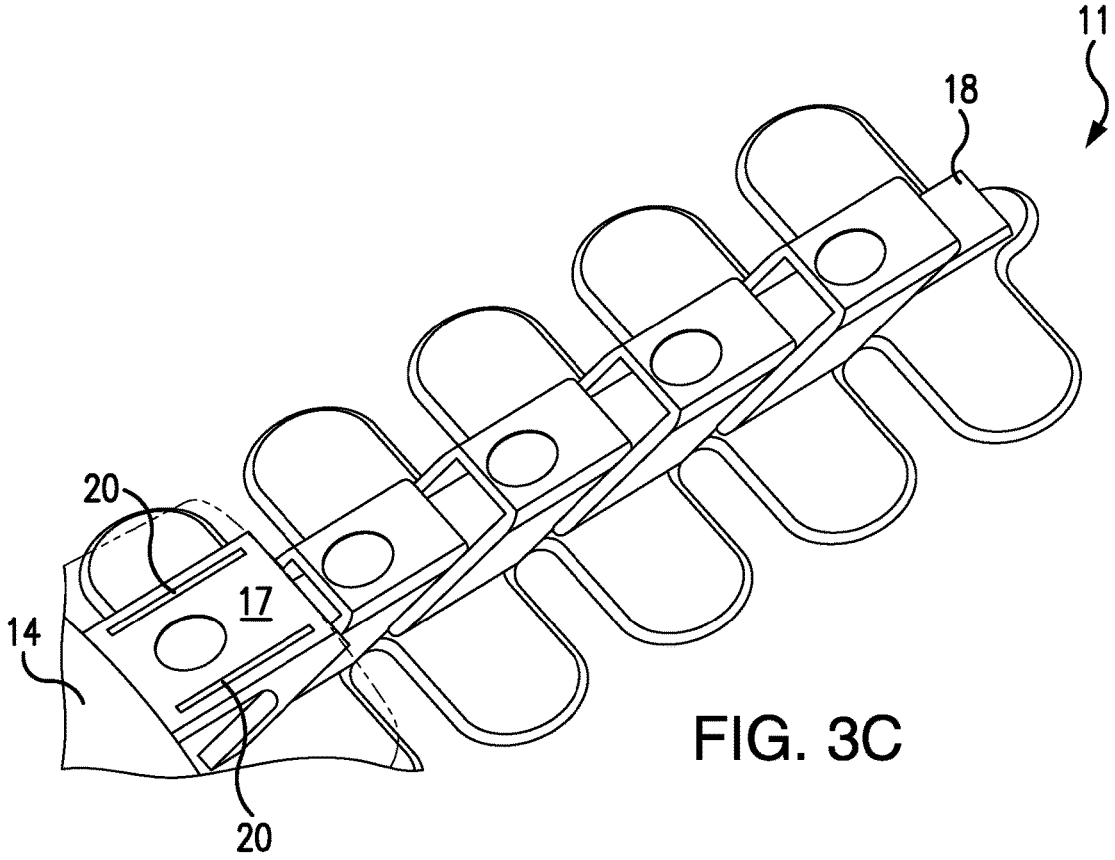

As depicted in FIGS. 3A-3C, the deflecting plates 14 are interchangeably attachable to multiple plate sockets 17, which are interconnected by a semi-rigid rail connector 18. As best seen in FIG. 3B, the deflecting plates 14 can removably attach to the plate sockets 17 by conjugate plates prongs 19 and socket slots 20, or other such conventional mechanical mating structures. Each of the plate sockets 17 is pivotally attached to one multiple pivot axes 21 which are transversely aligned to the longitudinal axis 22 of the rail connector 18. This configuration enables each of the plate sockets 17 to pivot about one of the pivot axes 21 independently of the other plate sockets 17.

Figure 2A:
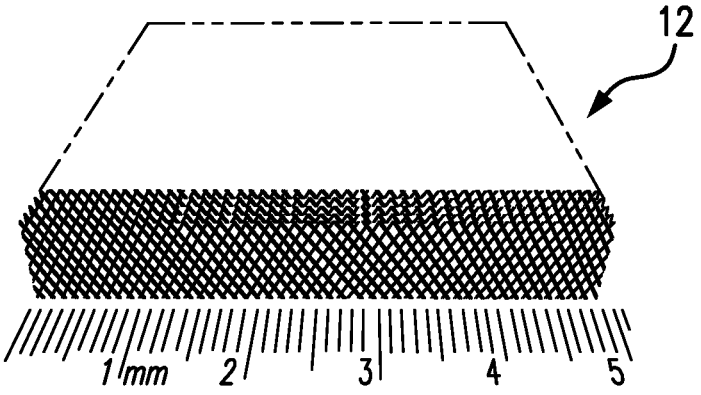
FIG. 2A is perspective view of an exemplary microlattice layer comprising a component of one embodiment of the present invention.
Figure 2B:
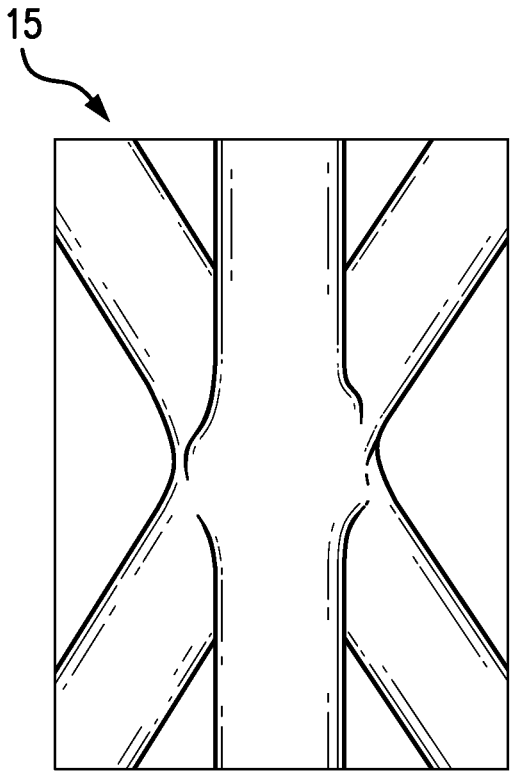
FIG. 2B is a magnified detail view of the exemplary microlattice of FIG. 2A under initial compression, showing incipient buckling deformation at microlattice nodes.
Figure 2C:
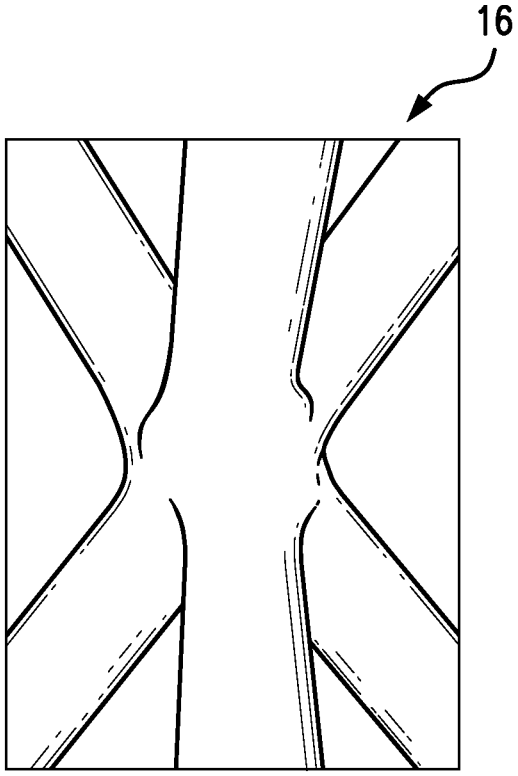
FIG. 2C is a magnified detail view of the exemplary microlattice of FIG. 2A under further compression, showing increased buckling deformation at microlattice nodes.

As shown in FIG. 2A, the lower microlattice layer 12 comprises a three-dimensional network of hollow nanotubes, preferably having tube diameters less than 1 mm. The nanotubes microscopic structure is depicted in FIGS. 2B and 2C, in which the microlattice is under increasing compression, with deformation progressing from incipient buckling at the nodes 15 to more advanced buckling 16. The buckling at the nanotubes' nodes damps impact forces, and the extremely small aspect ratio of the nanotubes' wall thickness to their diameter enables nearly full deformation recoverability.

As shown in FIG. 1, in body areas that are particularly exposed and/or vulnerable to impacts, such as the back and shoulders, an impact-dissipating middle gel layer 13 is interposed between the outer impact-deflecting layer 11 and the lower impact-damping microlattice layer 12. The viscoelastic polymeric gel 13 redirects the kinetic energy of the impact orthogonally to the impact direction so that a downward impact is directed outward along a horizontal plane, rather than penetrating in a downward direction. This dissipative effect reduces the force which passes through to the lower microlattice layer 12, thereby synergistically improving the impact-damping efficiency of the microlattice layer 12. The density and/or thickness of the gel layer 13 can be adjusted to the force level of the impacts against which the garment is designed to protect. For example, in military and police garments, a denser, thicker gel layer 13 can be deployed to dissipate the penetrative impacts of bullets and knives.

The material composing the rigid, impact-deflecting outer layer 11 of the exemplary garment structure 10 can be varied, depending on the application. In sports uses, it is preferably made of a rigid, light-weight, impact-resistant plastic or ceramic material, while in military/police uses, it is preferably composed of a ballistic and puncture resistant material, such as reinforced plastic, titanium metal or aramid fibers.

Figure 4:
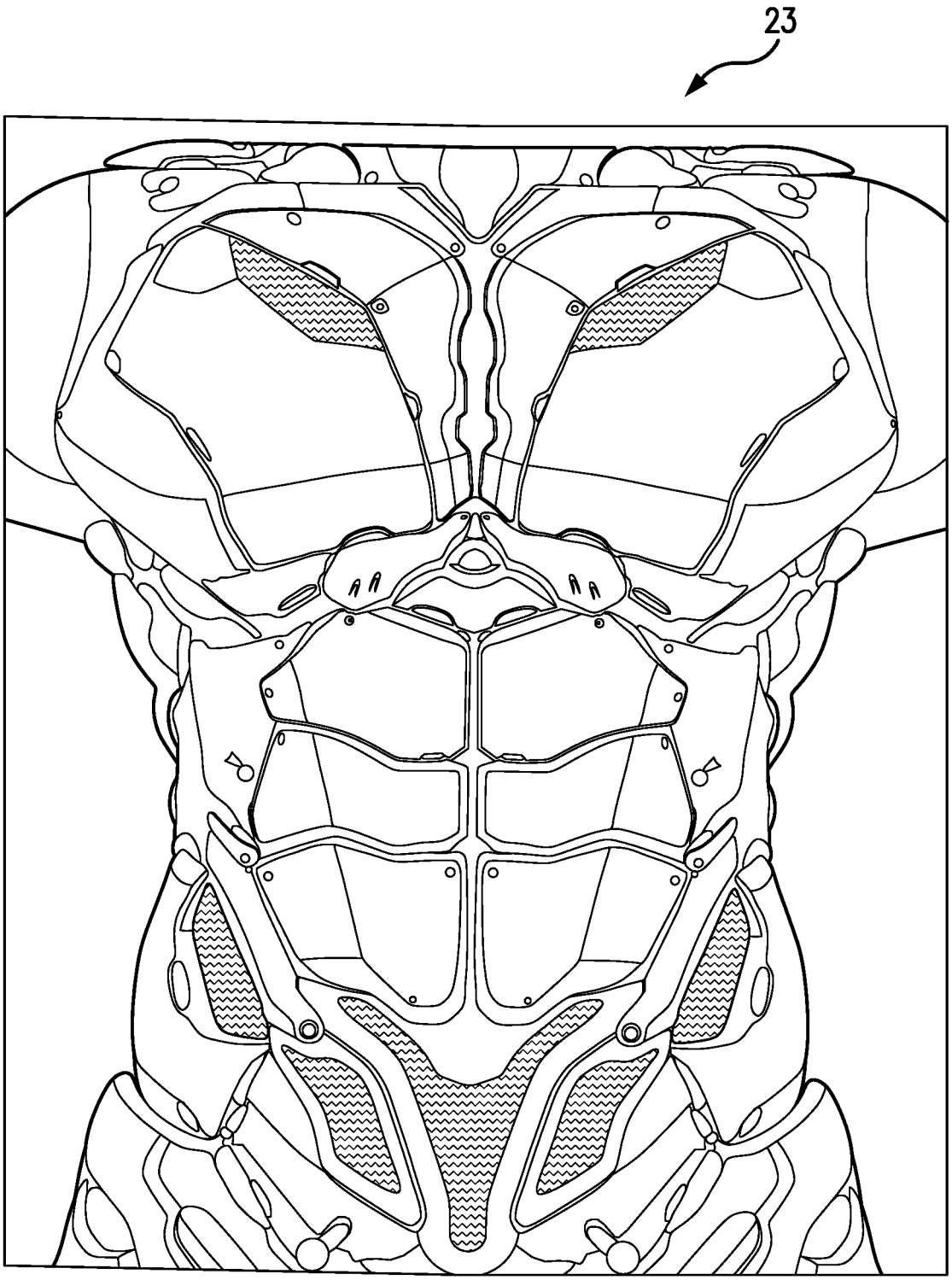
FIG. 4 is front perspective view of an exemplary exoskeleton comprising multiple impact resistant structures according to the present invention.

As shown in FIG. 4, a complete or partial exoskeleton 23 can be assembled from articulate panels having the multilayer composite structure of the present invention.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed:

1. A protective garment comprising:

one or more linear or curvilinear, impact-deflecting, single-file plate arrays, wherein none of the one or more linear or curvilinear, impact-deflecting, single-file plate arrays are interconnected with any other of the one or more linear or curvilinear, impact-deflecting, single-file plate arrays, and wherein each of the one or more linear or curvilinear, impact-deflecting, single-file plate arrays consists of multiple rigid deflecting plates, wherein the rigid deflecting plates are articulated, discrete and separate from one another and are interchangeably attached to multiple plate sockets, and wherein the plate sockets are interconnected in single-file by a congruously linear or curvilinear semi-rigid oblong rail connector, along a longitudinal axis of the congruously linear or curvilinear semi-rigid oblong rail connector, and wherein the congruously linear or curvilinear semi-rigid oblong rail connector is continuous and non-segmented, and wherein each of the plate sockets is pivotally attached to one of multiple pivot axes aligned single file in the congruously linear or curvilinear semi-rigid rail oblong connector, and wherein each of the pivot axes is transversely aligned to the longitudinal axis of the congruously linear or curvilinear semi-rigid oblong rail connector, and wherein each of the plate sockets independently pivots about one of the pivot axes in the congruously linear or curvilinear oblong semi-rigid rail connector;

one or more impact-dissipating viscoelastic polymeric gel layers; and one or more impact-damping microlattice layers.

2. The protective garment according to claim 1, wherein the one or more impact-damping microlattice layers comprise a three-dimensional network of multiple hollow polymer nanotubes, having nanotube diameters less than 1 mm, and wherein the polymer nanotubes are interconnected at multiple nanotube nodes which undergo resilient deformation under an applied stress, thereby effecting a damping of an applied stress.

3. The protective garment according to claim 1, wherein each of the deflecting plates comprises a rigid, impact-resistant plastic, polymer, polymer blend, or ceramic material.

4. The protective garment according to claim 1, wherein some or all of the rigid deflecting plates comprise a rigid plastic or metal material which is ballistic and puncture resistant.

5. The protective garment according to claim 3, wherein some or all of the rigid deflecting plates comprise convex shells, which are sized and contoured to conform to a size and a shape of a covered body part over which the convex shell is to be worn.

6. The protective garment according to claim 4, wherein some or all of the rigid deflecting plates comprise convex shells, which are sized and contoured to conform to a size and a shape of a covered body part over which the convex shell is to be worn.

7. The protective garment according to claim 5, wherein each of the convex shells are sized and contoured by 3D printing in conjunction with 3D optical scanning of the covered body part.

8. The protective garment according to claim 6, wherein each of the convex shells are sized and contoured by 3D printing in conjunction with 3D optical scanning of the covered body part.

9. The protective garment according to claim 5, wherein some or all of the one or more linear or curvilinear, impact-deflecting, single-file plate arrays are aligned with a body joint or a spinal column.

10. The protective garment according to claim 6, wherein some or all of the one or more linear or curvilinear, impact-deflecting, single-file plate arrays are aligned with a body joint or a spinal column.

11. The protective garment according to claim 7, wherein some or all of the one or more linear or curvilinear, impact-deflecting, single-file plate arrays are aligned with a body joint or a spinal column.

12. The protective garment according to claim 8, wherein some or all of the one or more linear or curvilinear, impact-deflecting, single-file plate arrays are aligned with a body joint or a spinal column.

13. The protective garment according to claim 9, wherein some or all of the one or more impact-dissipating viscoelastic polymeric gel layers are positioned below one of the one or more linear or curvilinear, impact-deflecting, single-file plate arrays and above one of the one or more impact-damping microlattice layers.

14. The protective garment according to claim 10, wherein some or all of the one or more impact-dissipating viscoelastic polymeric gel layers are positioned below one of the one or more linear or curvilinear, impact-deflecting, single-file plate arrays and above one of the one or more impact-damping microlattice layers.

15. The protective garment according to claim 11, wherein some or all of the one or more impact-dissipating viscoelastic polymeric gel layers are positioned below one of the one or more linear or curvilinear, impact-deflecting, single-file plate arrays and above one of the one or more impact-damping microlattice layers.

16. The protective garment according to claim 12, wherein some or all of the one or more impact-dissipating viscoelastic polymeric gel layers are positioned below one of the one or more linear or curvilinear, impact-deflecting, single-file plate arrays and above one of the one or more impact-damping microlattice layers.

* * * * *